US008900528B2

(12) United States Patent
Hamachi et al.

(10) Patent No.: US 8,900,528 B2
(45) Date of Patent: Dec. 2, 2014

(54) DISC-SHAPED ANALYSIS CHIP

(75) Inventors: Kenji Hamachi, Kyoto (JP); Keiji Iwamoto, Kyoto (JP); Kazuhiro Oguchi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 74 days.

(21) Appl. No.: 13/560,524

(22) Filed: Jul. 27, 2012

(65) Prior Publication Data

US 2013/0029361 A1 Jan. 31, 2013

(30) Foreign Application Priority Data

Jul. 29, 2011 (JP) ..... 2011-166132
Jan. 6, 2012 (JP) ..... 2012-001165

(51) Int. Cl.
*B01L 3/00* (2006.01)

(52) U.S. Cl.
CPC ..... *B01L 3/50273* (2013.01); *B01L 2200/0621* (2013.01); *B01L 2300/0864* (2013.01); *B01L 2300/0867* (2013.01); *B01L 2300/0861* (2013.01); *B01L 2300/0803* (2013.01); *B01L 2200/027* (2013.01); *B01L 2400/0409* (2013.01)
USPC ..... 422/502; 422/68.1; 422/72; 422/500; 422/506

(58) Field of Classification Search
USPC ..... 210/380.1
See application file for complete search history.

(56) References Cited

U.S. PATENT DOCUMENTS 8,539,823 B2 * 9/2013 Lee ..... 73/64.56
2009/0004059 A1 * 1/2009 Pugia et al. ..... 422/68.1

OTHER PUBLICATIONS

Watts, A. S.; Urbas, A. A.; Moschou, E.; Gavalas, V. G.; Zoval, J. V.; Madou, M.; and Bachas, L. G.; Centrifugal microfluidics with integrated sensing microdome optodes for multiion detection, (2007), Anal. Chem., 79, p. 8046-8054.*

Lai, S; Wang, S.; Luo, J.; Lee, L. J.; Yang, S.; and Madou, M. J.; Design of a compact disk-like microfluidic platform for enzyme-linked immunosorbent assay, (2004), Anal. Chem., 76, p. 1832-1837.*

Puckett, L. G.; Dikici, E.; Lai, S.; Madou, M.; Bachas, L. G.; and Daunert, S.; Investigation into the applicability of the centrifugal microfluidics platform for the development of protein-ligand binding assays incorporating enhanced green fluorescent protein as a fluorescent reporter, (2004), Anal. Chem., 76, p. 7263-7268.*

Nakajima, Hizuru, "Flow Analysis Using Compact Disk Type Microchip," Japan Society for Analytical Chemistry, pp. 381-382 (Jul. 2009) (with English translation).

* cited by examiner

*Primary Examiner* — Christine Foster
*Assistant Examiner* — Ellen J Marcsisin
(74) *Attorney, Agent, or Firm* — Fish & Richardson P.C.

(57) ABSTRACT

A disc-shaped analysis chip has an internal space. The internal space includes: a first reservoir for accommodating a first liquid; a second reservoir and a third reservoir arranged nearer to an outer peripheral portion of the analysis chip than the first reservoir; a fourth reservoir, a fifth reservoir and a sixth reservoir for accommodating a second liquid, a third liquid and a fourth liquid, respectively, and being arranged nearer to the outer peripheral portion of the analysis chip than the second and the third reservoir; a seventh reservoir arranged nearer to the outer peripheral portion of the analysis chip than the fourth to the sixth reservoir; an eighth reservoir arranged nearer to the outer peripheral portion of the analysis chip than the seventh reservoir; and a first to an eighth flow path for appropriately interconnecting the first to the eighth reservoir.

13 Claims, 11 Drawing Sheets

DISC-SHAPED ANALYSIS CHIP

CROSS-REFERENCE TO RELATED APPLICATIONS

This application is based upon and claims the benefit of priority from Japanese Patent Application Nos. 2011-166132, filed on Jul. 29, 2011 and 2012-1165, filed on Jan. 6, 2012, the entire contents of which are incorporated herein by reference.

TECHNICAL FIELD

The present disclosure relates to an analysis chip which can be used in various types of biochemical tests and, more specifically, to a disc-shaped analysis chip mounted on a centrifugal device.

BACKGROUND

In recent years, detecting or quantifying biological substances such as DNA (deoxyribonucleic acid), enzymes, antigens, antibodies, viruses, and other protein and cells is becoming increasingly more important in the fields of medical care, health, food and drug development, and so on. There are various ways, such as using analysis chips, to detect, measure and analyze biological substances in these various fields. Analysis chips have a number of advantages in that a series of detecting or quantifying operations conducted in a laboratory can be performed within a small chip, and the analysis can be performed by using minute amounts of a specimen and a reagent. However, the analysis chip could be improved in terms of acquiring more accurate readings of analysis data. For example, a processing mechanism or some force, such as centrifugal force, when applied to the liquid samples on the analysis chip, may cause small amount of residual liquids to seep or form in undesired portions of the analysis chip, such as within reservoirs and flow paths. This may adversely affect the accuracy of the testing and quantification of the objective biological substances housed by the analysis chip.

SUMMARY

The present disclosure includes various embodiments of an analysis chip capable of being used, for example, in testing biological and/or biochemical substances, and capable of achieving increased accuracy in the testing. The analysis chip may be mounted on a centrifugal device, such as a turntable, and rotated by a centrifugal force generated by rotation of the centrifugal device to react a specimen and a reagent with each other. The analysis chip may perform processes, such as the detection or quantification of objective substances by, for example, optical measurements.

According to one aspect of the present disclosure, a disc-shaped analysis chip includes an internal space (fluid circuit), and may be configured to move received liquids to desired positions within the internal space by application of a centrifugal force. In the disc-shaped analysis chip, the internal space (fluid circuit) may include: a first reservoir for accommodating therein a first liquid; a second reservoir and a third reservoir arranged nearer to an outer peripheral portion of the analysis chip than the first reservoir; a fourth reservoir for accommodating therein a second liquid, a fifth reservoir for accommodating therein a third liquid and a sixth reservoir for accommodating therein a fourth liquid, the fourth, fifth and sixth reservoirs being arranged nearer to the outer peripheral portion of the analysis chip than the second and third reservoirs; a seventh reservoir arranged nearer to the outer peripheral portion of the analysis chip than the fourth, fifth and sixth reservoirs; an eighth reservoir arranged nearer to the outer peripheral portion of the analysis chip than the seventh reservoir; a first flow path interconnecting the first reservoir and the second reservoir; a second flow path interconnecting the first reservoir and the third reservoir; a third flow path interconnecting the second reservoir and the fourth reservoir; a fourth flow path interconnecting the third reservoir and the fifth reservoir; a fifth flow path interconnecting the fourth reservoir and the seventh reservoir; a sixth flow path interconnecting the fifth reservoir and the seventh reservoir; a seventh flow path interconnecting the sixth reservoir and the seventh reservoir; and an eighth flow path interconnecting the seventh reservoir and the eighth reservoir.

In some embodiments, the internal space (fluid circuit) may further include: a ninth reservoir arranged nearer to the outer peripheral portion of the analysis chip than the first reservoir; a ninth flow path interconnecting the ninth reservoir and the first reservoir; a tenth flow path interconnecting the ninth reservoir and the sixth reservoir; a tenth reservoir arranged nearer to the outer peripheral portion of the analysis chip than the first reservoir; an eleventh flow path interconnecting the tenth reservoir and the first reservoir; and a twelfth flow path interconnecting the tenth reservoir and the seventh reservoir.

In some embodiments, the cross-sectional areas of the first, second, fifth, sixth, seventh and ninth flow paths may be larger than the cross-sectional area of the eighth flow path. The cross-sectional area of the eighth flow path may be larger than the cross-sectional areas of the third, fourth, tenth, eleventh and twelfth flow paths.

In some embodiments, the volume of the seventh reservoir may be equal to or smaller than the total volume of the second, third, ninth and tenth reservoirs.

In some embodiments, the fourth reservoir, the fifth reservoir and the sixth reservoir may have a first inlet port communicating with the outside of the analysis chip to introduce therethrough the second liquid into the fourth reservoir, a second inlet port communicating with the outside of the analysis chip to introduce therethrough the third liquid into the fifth reservoir and a third inlet port communicating with the outside of the analysis chip to introduce therethrough the fourth liquid into the sixth reservoir. The first inlet port may be arranged in a position deviated from a straight line extending in a centrifugal direction from a connection point between the third flow path and the fourth reservoir. The second inlet port may be arranged in a position deviated from a straight line that extends in the centrifugal direction from a connection point between the fourth flow path and the fifth reservoir. The third inlet port may be arranged in a position deviated from a straight line extending in the centrifugal direction from a connection point between the tenth flow path and the sixth reservoir.

In some embodiments, a connection point between the eleventh flow path and the first reservoir may be positioned nearer to the outer peripheral portion of the analysis chip than connection points of the first, second, and ninth, flow paths to the first reservoir.

In some embodiments, the fifth flow path, the sixth flow path and the seventh flow path may be connected to a region of the seventh reservoir facing the first reservoir. The twelfth flow path may be connected to a region of the seventh reservoir facing the eighth reservoir.

In some embodiments, the analysis chip may include a first substrate having grooves formed on one surface thereof and a second substrate laminated on the grooved surface of the first substrate. In this case, the internal space (fluid circuit) may be defined by the grooves and a surface of the second substrate facing the first substrate.

In some embodiments, the fourth reservoir may have a first inlet port communicating with the outside of the analysis chip to introduce therethrough the second liquid into the fourth reservoir The fifth reservoir may have a second inlet port communicating with the outside of the analysis chip to introduce therethrough the third liquid into the fifth reservoir. The sixth reservoir may have a third inlet port communicating with the outside of the analysis chip to introduce therethrough the third liquid into the sixth reservoir. The first reservoir may have a fourth inlet port communicating with the outside of the analysis chip to introduce therethrough the first liquid into the first reservoir.

In some embodiments, if the analysis chip includes the first substrate and the second substrate as described above, one or more of the first to the fourth inlet ports may be a through-hole extending through the second substrate in a thickness direction of the second substrate.

In some embodiments, the through-hole may be formed into a taper shape such that the diameter of the through-hole grows smaller toward the first substrate. In this case, the through-hole may extend in a perpendicular direction with respect to a surface of the second substrate. Alternatively, the through-hole may obliquely extend with respect to a surface of the second substrate such that the through-hole comes closer to the outer peripheral portion of the analysis chip as the through-hole extends toward the first substrate.

According to another aspect of the present disclosure, a method of using the analysis chip described above includes: a first liquid introduction process of introducing a washing fluid as a first liquid in the first reservoir, introducing as a second liquid a liquid containing a specimen to be analyzed and enzyme-labeled antibodies into the fourth reservoir and introducing antibody-modified beads as a third liquid into the fifth reservoir; a first reaction process of introducing the second liquid into the seventh reservoir through the fifth flow path by application of a first centrifugal force, introducing the third liquid into the seventh reservoir through the sixth flow path by the application of the first centrifugal force and reacting the second liquid and the third liquid with each other; a washing process of introducing the first liquid into the seventh reservoir by application of a second centrifugal force larger than the first centrifugal force, washing the beads reacted in the first reaction process and moving the first liquid used in washing the beads to the eighth reservoir through the eighth flow path; a second liquid introduction process of introducing a substrate solution as the fourth liquid into the sixth reservoir; and a second reaction process of introducing the fourth liquid into the seventh reservoir through the seventh flow path by application of a third centrifugal force and reacting the fourth liquid with the beads washed in the washing process.

The washing process including the step of the first liquid within the first reservoir being introduced into the seventh reservoir via a first to a fourth route: the first route passing through the ninth flow path, the ninth reservoir, the tenth flow path, the sixth reservoir and the seventh flow path in the named order; the second route passing through the second flow path, the third reservoir, the fourth flow path, the fifth reservoir and the sixth flow path in the named order; the third route passing through the first flow path, the second reservoir, the third flow path, the fourth reservoir and the fifth flow path in the named order; and the fourth route passing through the eleventh flow path, the tenth reservoir and the twelfth flow path in the named order.

According to some other embodiments, a disc-shaped analysis chip of the present disclosure, may be configured such that the inside of the fourth reservoir and the fifth reservoir respectively accommodating the second liquid and the third liquid are washed in the washing process. Accordingly, the second liquid and the third liquid remaining within the fourth reservoir and the fifth reservoir can be prevented from flowing out in the process subsequent to the washing process, and thus accuracy can be increased when testing specimens.

BRIEF DESCRIPTION OF THE DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

DETAILED DESCRIPTION

Reference will now be made in detail to various embodiments, examples of which are illustrated in the accompanying drawings. In the following detailed description, numerous specific details are set forth in order to provide a thorough understanding of the inventive aspects of this disclosure. However, it will be apparent to one of ordinary skill in the art that the inventive aspect of this disclosure may be practiced without these specific details. In other instances, well-known methods, procedures, systems, and components have not been described in detail so as not to unnecessarily obscure aspects of the various embodiments.

As one example of an analysis chip that may be used in an apparatus of device for analyzing biological and biochemical specimens or substances, an analysis chip includes a plurality of reservoirs and a plurality of minute flow paths interconnecting the reservoirs formed on a disc-shaped substrate, e.g., a compact disk (having a circuit or pattern of reservoirs and flow paths formed on the substrate of the analysis chip, which may collectively be referred to as a "fluid circuit"). In this analysis chip, liquids (a specimen and a reagent) may be received in the reservoirs and are moved by a centrifugal force generated by rotation of the disk about a centrifugal center and subjected to a specific chemical reaction. The disc-shaped analysis chip has a number of benefits, including that peripheral devices, such as pumps and valves, need not be employed due to the use of a centrifugal force, and thus the overall size of the analysis system can be reduced.

The analysis chip may be utilized in various types of examination and analysis methods (e.g., in various kinds of reaction systems). One example of an examination and analysis method is an Enzyme-Linked Immunosorbent Assay ("ELISA"), which is often used in biochemical testing. The ELISA is one method for quantitatively detecting a minute amount of objective substances (e.g., examination target substances) contained in a specimen through the use of an enzyme reaction. The ELISA is excellent for quantification of such analyses because objective substances can be detected with high sensitivity.

In the ELISA, an antigen-antibody reaction is performed by mixing: 1) a specimen containing objective substances; 2) solid phases such as beads modified to antibodies uniquely binding with the objective substances; and 3) antibodies labeled with enzymes and uniquely binding with conjugants of the objective substances and the beads modified to the antibodies (hereinafter referred to as "enzyme-labeled antibodies"). Thereafter, unreacted specimen (components other than the objective substances) and the unreacted enzyme-labeled antibodies are removed by washing and an enzyme reaction is performed with a substrate solution. The objective substances can be quantified by detecting a fluorescent material produced by the above-described processes.

Figure 1:
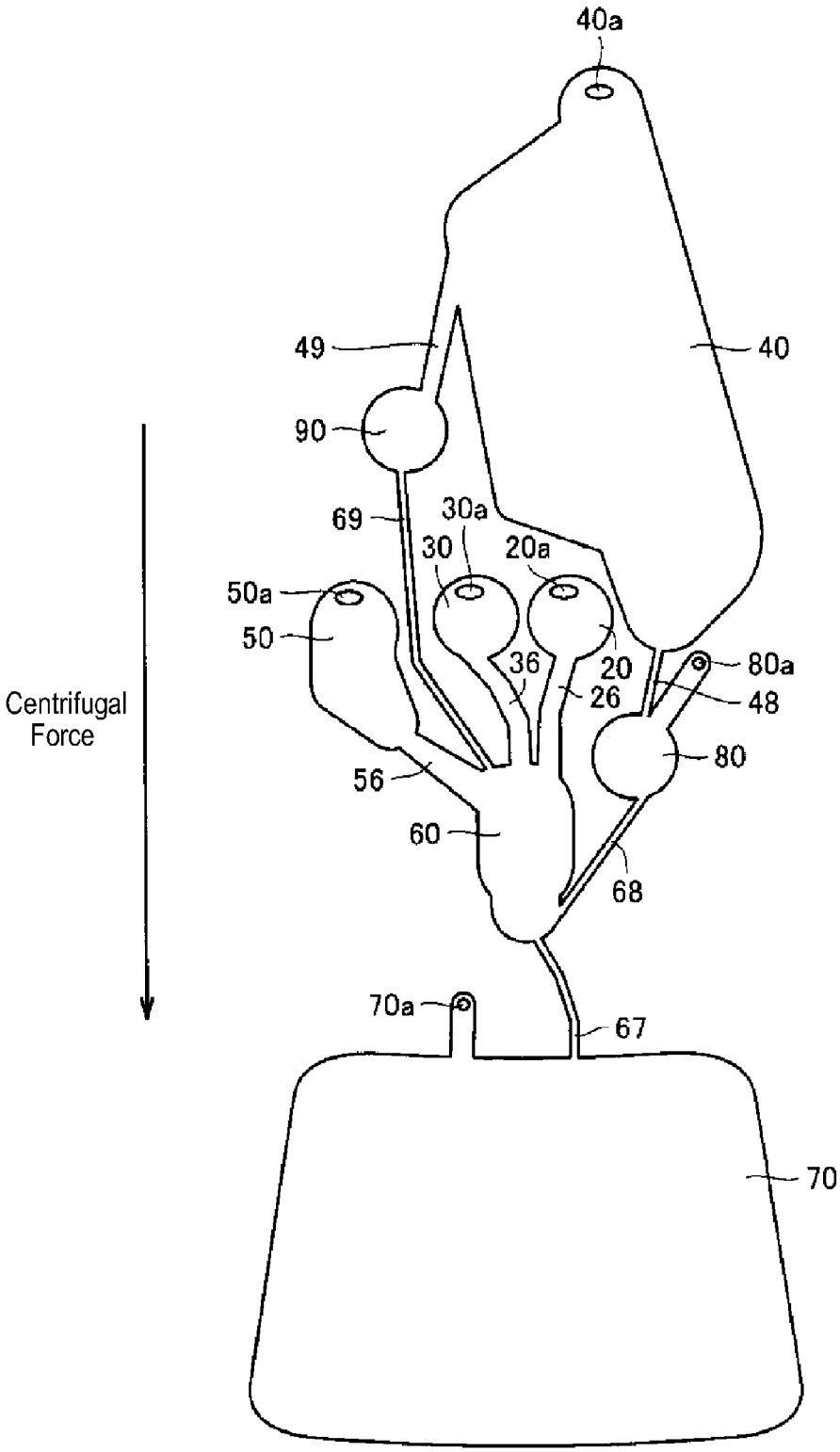
FIG. 1 is a schematic top view illustrating a fluid circuit structure of an analysis chip capable of performing an Enzyme-Linked Immunosorbent Assay ("ELISA").

FIG. 1 is an illustration of a disc-shaped analysis chip having a fluid circuit and capable of implementing the ELISA. The fluid circuit shown in FIG. 1 is formed on a disc-shaped substrate as a groove pattern. The upward direction in FIG. 1 is a direction toward the center of the disc-shaped substrate. The downward direction in FIG. 1 is a direction toward the periphery of the disc-shaped substrate.

The fluid circuit shown in FIG. 1 includes: a reservoir 20 for accommodating therein a first liquid (e.g., a liquid containing a specimen containing objective substances and enzyme-labeled antibodies) (the reservoir 20 having an inlet port 20*a* for introducing therethrough the specimen containing the objective substances and the enzyme-labeled antibodies); a reservoir 30 for accommodating therein a second liquid (e.g., a liquid containing antibody-modified beads) (the reservoir 30 having an inlet port 30*a* for introducing therethrough the liquid containing the antibody-modified beads); a reservoir 40 for accommodating therein a third liquid (e.g., a washing fluid) (the reservoir 40 having an inlet port 40*a* for introducing therethrough the washing fluid); a reservoir 50 for accommodating therein a fourth liquid (e.g., a substrate solution) (the reservoir 50 having an inlet port 50*a* for introducing therethrough the substrate solution); a reservoir 60 arranged nearer to the outer peripheral portion of the analysis chip than the reservoirs 20, 30, 40 and 50; a reservoir 70 arranged nearer to the outer peripheral portion of the analysis chip than the reservoir 60 (the reservoir 70 having an air hole 70*a*); reservoirs 80 and 90 arranged between the reservoir 40 and the reservoir 60 (the reservoir 80 having an air hole 80*a*); a flow path 26 interconnecting the reservoir 20 and the reservoir 60; a flow path 36 interconnecting the reservoir 30 and the reservoir 60; a flow path 56 interconnecting the reservoir 50 and the reservoir 60; a flow path 67 interconnecting the reservoir 60 and the reservoir 70; a flow path 48 interconnecting the reservoir 40 and the reservoir 80; a flow path 68 interconnecting the reservoir 60 and the reservoir 80; a flow path 49 interconnecting the reservoir 40 and the reservoir 90; and a flow path 69 interconnecting the reservoir 60 and the reservoir 90.

The cross-sectional areas of the respective flow paths are set such that: the cross-sectional area of the flow path 49=(≈) the cross-sectional area of the flow path 26=(≈) the cross-sectional area of the flow path 36=(≈) the cross-sectional area of the flow path 56>the cross-sectional area of the flow path 67>the cross-sectional area of the flow path 69=(≈) the cross sectional area of the flow path 48=(≈) the cross-sectional area of the flow path 68. Moreover, at least one of the cross sections of the flow path 67 has a size smaller than the sizes of the antibody-modified beads.

In order to prevent leakage of a liquid from the fluid circuit, a laminated member, such as a substrate or a sticky seal, for covering the fluid circuit is placed on the disc-shaped substrate having the groove pattern (fluid circuit) formed thereon. In the laminated member, there are formed the inlet port 20*a* for introducing therethrough the specimen and the enzyme-labeled antibodies, the inlet port 30*a* for introducing therethrough the liquid containing the antibody-modified beads, the inlet port 40*a* for introducing therethrough the washing fluid and the inlet port 50*a* for introducing therethrough the substrate solution. These inlet ports 20*a* to 50*a* are through-holes extending in the thickness direction of the laminated member. The air holes 70*a* and 80*a* are holes through which the fluid circuit communicates with the outside of the analysis chip. The air holes 70*a* and 80*a* can be made up of grooves formed on the disc-shaped substrate and through-holes formed in the laminated member placed on the disc-shaped substrate and communicating with the grooves.

With the analysis chip having the fluid circuit shown in FIG. 1, examinations relying upon the ELISA can be implemented in the following order through the use of a centrifugal force.

A first liquid containing the specimen containing the objective substances and the enzyme-labeled antibodies, a second liquid containing the antibody-modified beads and a third liquid (the washing fluid) are introduced into the reservoir 20, the reservoir 30 and the reservoir 40, respectively. Then, the analysis chip is rotated about the center thereof and a first centrifugal force is applied to the analysis chip in the direction shown in FIG. 1, whereby the first liquid containing the specimen containing the objective substances and the enzyme-labeled antibodies and the second liquid containing the antibody-modified beads are introduced into the reservoir 60 and mixed with each other and thus an antigen-antibody reaction is performed. The magnitude of the first centrifugal force is set such that the liquid in the reservoir 60 is prevented from flowing into the reservoir 70 through the flow path 67.

Subsequently, a second centrifugal force having a magnitude larger than that of the first centrifugal force is applied to the analysis chip in the direction shown in FIG. 1, thereby moving the liquid in the reservoir 60 to the reservoir 70 and discarding the liquid from the reservoir 60. At the same time, a portion of the washing fluid (the third liquid) in the reservoir 40 is introduced into the reservoir 60 via a first route consisting of the flow path 49, the reservoir 90 and the flow path 69 and a second route consisting of the flow path 48, the reservoir 80 and the flow path 68, thereby washing the conjugant of the objective substances, the antibody-modified beads and the enzyme-labeled antibodies in the reservoir 60. Thereafter, the washing fluid is moved to the reservoir 70. By repeating application and release of the second centrifugal force, multi-stage washing in which the above-described washing process is carried out by two or more times is performed. The unreacted specimen and the unreacted enzyme-labeled antibodies are removed by the above-described washing process. After the liquid level of the washing fluid in the reservoir 40 has become lower than the connection position of the flow path 49 and the reservoir 40 (has moved toward the outer peripheral portion of the analysis chip beyond the connection position) during the washing process, the washing fluid in the reservoir 40 is introduced into the reservoir 60 only through the second route.

Then, the substrate solution is introduced into the reservoir 50. Thereafter, the substrate solution in the reservoir 50 is introduced into the reservoir 60 and an enzyme reaction is performed by applying a third centrifugal force having a magnitude substantially equal to that of the first centrifugal force in the direction shown in FIG. 1. The magnitude of the third centrifugal force is set such that the liquid in the reservoir 60 is prevented from flowing into the reservoir 70 through the flow path 67. Finally, the fluorescent material generated within the reservoir 60 by the enzyme reaction is detected (by irradiating detection light on the reservoir 60), thereby quantifying the objective substances.

As set forth above, with the analysis chip having the fluid circuit shown in FIG. 1, performing the antigen-antibody reaction, performing the washing through the introduction of the washing fluid and then performing the enzyme reaction can be carried out by sequentially applying the first to the third centrifugal force in the same direction.

However, due to the centrifugal force applied after the first and the second liquid are introduced into the reservoir 60, a small amount of residual liquids in the reservoirs 20 and 30 flow into the reservoir 60. This may affect the accuracy of the analysis and/or quantification of the objective substances.

<Disc-Shaped Analysis Chip>

Figure 2:
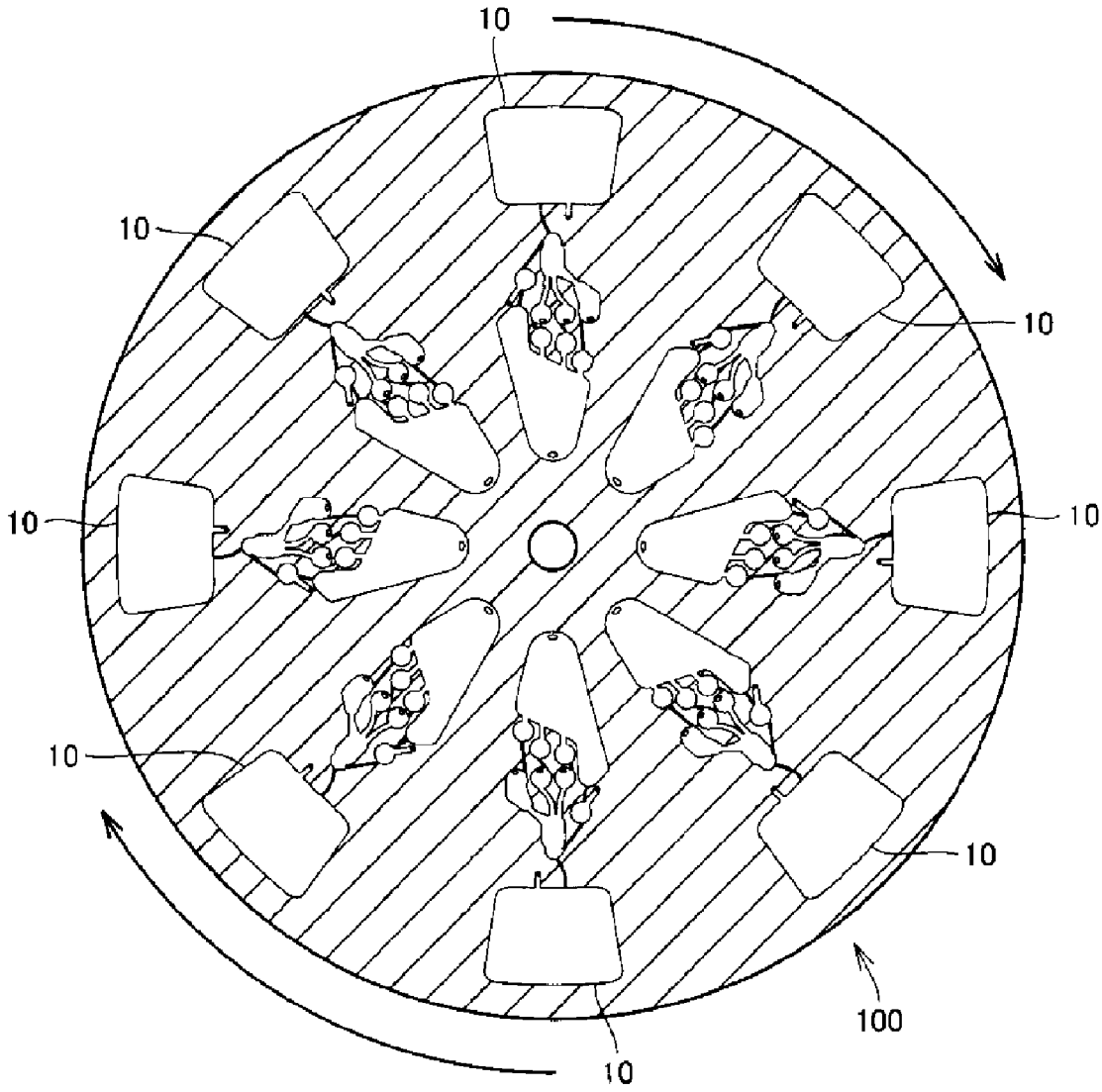
FIG. 2 is a schematic top view showing an example of a disc-shaped analysis chip, according to some embodiments.

FIG. 2 is a schematic top view illustrating an example of a disc-shaped analysis chip according to some embodiments. The disc-shaped analysis chip 100 shown in FIG. 2 includes fluid circuits 10, each of which includes various kinds of reservoirs and minute flow paths interconnecting the reservoirs. By rotating the analysis chip 100 at an appropriate rotation speed in a particular direction, e.g., the direction indicated by the arrows (or in the opposite direction) to apply an appropriate magnitude of centrifugal force to the analysis chip 100, liquids (such as a specimen, a reagent, a washing fluid and a waste liquid) contained in the fluid circuits 10 can be directed to desired positions (reservoirs) in the fluid circuits 10. The disc-shaped analysis chip 100 of the example shown in FIG. 2 includes eight fluid circuits 10 having the same shape (pattern) and thus eight kinds of examinations and analyses can be simultaneously performed. The eight fluid circuits 10 are arranged to extend in the radial direction of a disk (i.e., in the direction of the centrifugal force generated when the analysis chip 100 is rotated about the centrifugal center, i.e., the center of the disk). Though the number of the fluid circuits 10 is eight in the example shown in FIG. 2, the present disclosure is not limited thereto. The number of the fluid circuits 10 may be smaller than or larger than eight.

The fluid circuits 10 are spaces formed inside the disc-shaped analysis chip 100. The disc-shaped analysis chip 100 having the fluid circuits 10 can be manufactured by forming a groove pattern corresponding to a fluid circuit structure on a disc-shaped first substrate and then placing and bonding a second substrate on the grooved surface of the first substrate. A groove pattern forming the fluid circuits may also be formed on the second substrate. Alternatively, a disc-shaped analysis chip 100 may be manufactured by placing, instead of the second substrate, a laminated member such as a sticky seal (sticky label) or the like on the grooved surface of the first substrate.

A substrate material forming the disc-shaped analysis chip 100 is not particularly limited and may be, e.g., polymethyl methacrylate (PMMA), polydimethylsiloxane (PDMS), glass, cycloolefin polymer (COP), cycloolefin copolymer (COC), polyethylene terephthalate (PET), polystyrene (PS) or polypropylene (PP). From the viewpoint of industrial productivity, PMMA, PET, COP or COC may be used. If fluorescence measurement is performed in the analysis using the disc-shaped analysis chip 100, the substrate material may be a material hardly generating fluorescence. The material hardly generating fluorescence may be a (meta) acryl-based resin or a cycloolefin-based resin. More specifically, the material hardly generating fluorescence may be PMMA, COP or COC.

The thickness of the disc-shaped analysis chip 100 is not particularly limited but may range from 0.1 mm to 100 mm. In some embodiments, the thickness of the disc-shaped analysis chip 100 may range from 2 mm to 3 mm. The method of forming the groove patterns on the substrates of the disc-shaped analysis chip 100 is not particularly limited and may be, e.g., machining, sandblasting or injection molding. Examples of the method of bonding the substrates together may include welding the substrates by melting the attachment surface of at least one of the substrates (a welding method) and bonding the substrates through the use of an adhesive agent. Examples of the welding method may include: welding the substrates by heating the substrates; welding the substrates by the heat generated when the substrates absorbs, e.g., laser light irradiated on the substrates (a laser welding method); and welding the substrates through the use of ultrasonic waves. Among these methods, the laser welding method may be used in some embodiments.

Figure 3:
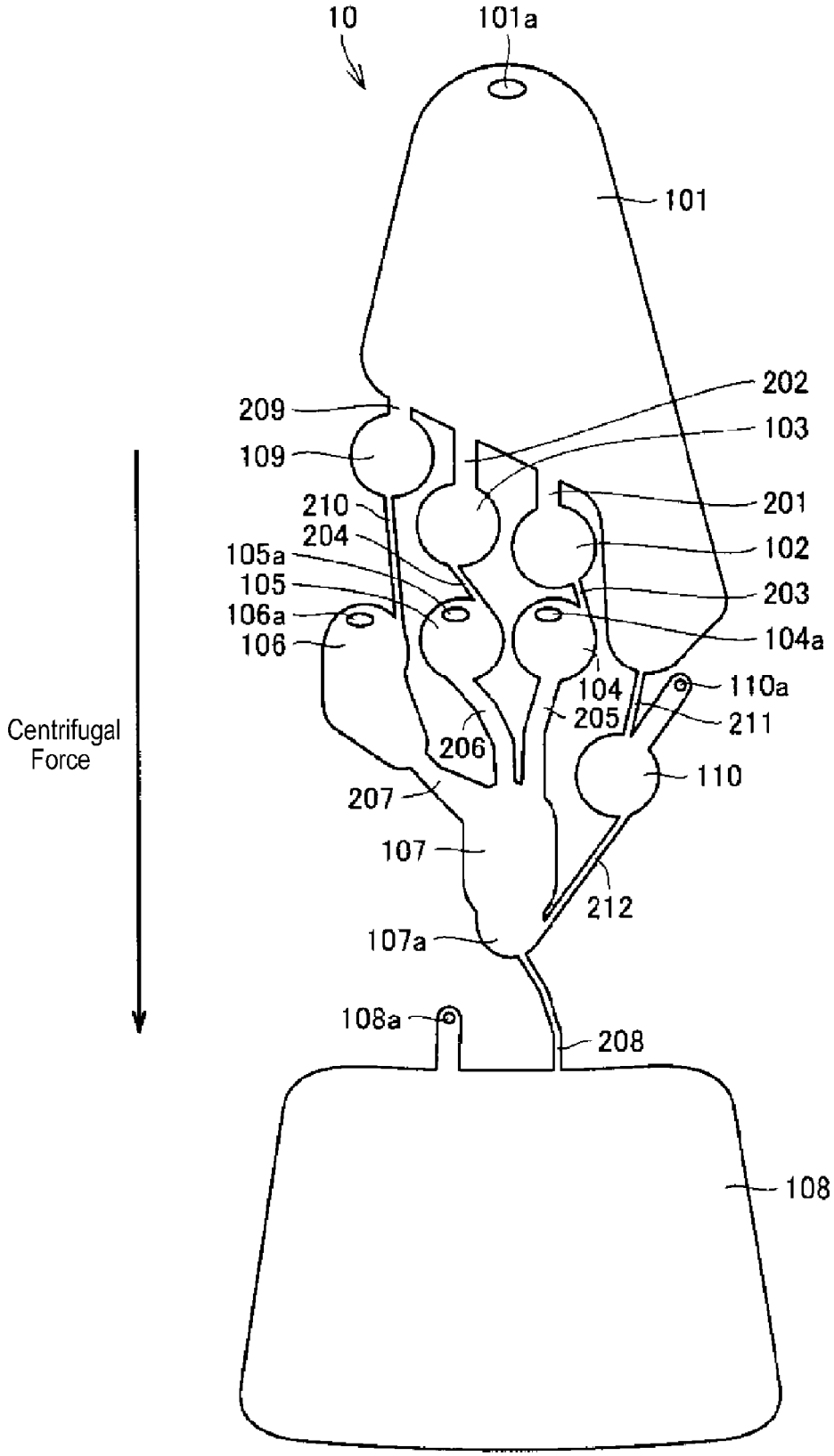
FIG. 3 is a schematic top view showing one example of a fluid circuit structure employed in a disc-shaped analysis chip of FIG. 2.

Next, the structure of the fluid circuit employed in the present disc-shaped analysis chip 100 will be described in detail. FIG. 3 is a schematic top view illustrating an example of a fluid circuit structure employed in the present disc-shaped analysis chip 100 of FIG. 2, according to some embodiments. FIG. 3 shows, on an enlarged scale, the fluid circuit 10 of the disc-shaped analysis chip 100 shown in FIG. 2. The fluid circuit 10 of the disc-shaped analysis chip 100 has a structure suitably applicable to an examination such as the ELISA or the like.

As shown in FIG. 3, the fluid circuit 10 includes: a first reservoir 101 for accommodating therein a first liquid; a second reservoir 102 and a third reservoir 103 arranged nearer to the outer peripheral portion of the analysis chip 100 than the first reservoir 101; a fourth reservoir 104, a fifth reservoir 105 and a sixth reservoir 106 for accommodating therein a second liquid, a third liquid and a fourth liquid, respectively, and arranged nearer to the outer peripheral portion of the analysis chip 100 than the second and third reservoirs 102 and 103; a seventh reservoir 107 arranged nearer to the outer peripheral portion of the analysis chip 100 than the fourth to the sixth reservoir 104 to 106; an eighth reservoir 108 arranged nearer to the outer peripheral portion of the analysis chip 100 than the seventh reservoir 107; a first flow path 201 interconnecting the first reservoir 101 and the second reservoir 102; a second flow path 202 interconnecting the first reservoir 101 and the third reservoir 103; a third flow path 203 interconnecting the second reservoir 102 and the fourth reservoir 104; a fourth flow path 204 interconnecting the third reservoir 103 and the fifth reservoir 105; a fifth flow path 205 interconnecting the fourth reservoir 104 and the seventh reservoir 107; a sixth flow path 206 interconnecting the fifth reservoir 105 and the seventh reservoir 107; a seventh flow path 207 interconnecting the sixth reservoir 106 and the seventh reservoir 107; an eighth flow path 208 interconnecting the seventh reservoir 107 and the eighth reservoir 108; a ninth reservoir 109 arranged nearer to the outer peripheral portion of the analysis chip 100 than the first reservoir 101, the ninth reservoir 109 being connected to the first reservoir 101 via a ninth flow path 209 and connected to the sixth flow path 206 via a tenth flow path 210; and a tenth reservoir 110 arranged nearer to the outer peripheral portion of the analysis chip 100 than the first reservoir 101, the tenth reservoir 110 being connected to the first reservoir 101 via an eleventh flow path 211 and connected to the seventh reservoir 107 via a twelfth flow path 212.

Four flow paths for discharging the first liquid, i.e., the ninth flow path 209, the second flow path 202, the first flow path 201 and the eleventh flow path 211, are connected to the first reservoir 101. The connection points between the respective flow paths 201, 202, 209 and 211 and the first reservoir 101 differ from one another in the radial direction (centrifugal direction) of the analysis chip 100. In particular, due to the provision of a convex portion in the first reservoir 101, the connection point between the eleventh flow path 211 and the first reservoir 101 is positioned far nearer to the outer peripheral portion of the analysis chip 100 than the connection points with other flow paths 201, 202 and 209.

The second reservoir 102, the third reservoir 103, the ninth reservoir 109 and the tenth reservoir 110 are disposed on the routes extending from the first reservoir 101 to the seventh reservoir 107 and serve as buffer reservoirs for temporarily accommodating therein the first liquid. The existence of the buffer reservoirs allows the first liquid in the first reservoir 101 to be divisionally (in a multi-step manner) introduced into the seventh reservoir 107.

The fourth reservoir 104, the fifth reservoir 105 and the sixth reservoir 106 are provided with a first inlet port 104*a* for introducing therethrough the second liquid into the fourth reservoir 104, a second inlet port 105*a* for introducing therethrough the third liquid into the fifth reservoir 105 and a third inlet port 106*a* for introducing therethrough the fourth liquid into the sixth reservoir 106, respectively. The first to the third inlet ports 104*a* to 106*a* communicate with the outside of the analysis chip 100. Similarly, the first reservoir 101 is provided with a fourth inlet port 101*a* for introducing therethrough the first liquid into the first reservoir 101. The fourth inlet port 101*a* communicates with the outside of the analysis chip 100. These inlet ports 101*a*, 104*a*, 105*a* and 106*a* are through-holes extending in the thickness direction of the analysis chip 100 and are formed in the second substrate or the sticky seal (sticky label) placed on the first substrate. The through-holes may have the same function as that of air holes to be described later.

As shown in FIG. 3, the first inlet port 104*a*, the second inlet port 105*a* and the third inlet port 106*a* may be arranged in positions which are deviated from the straight lines extending in the centrifugal direction from the connection point between the third flow path 203 and the fourth reservoir 104, from the connection point between the fourth flow path 204 and the fifth reservoir 105 and from the connection point between the tenth flow path 210 and the sixth reservoir 106, respectively. This configuration allows for the prevention of the first liquid from being leaked through the inlet ports 104*a*, 105*a* and 106*a* when the first liquid in the first reservoir 101 are introduced into the fourth reservoir 104, the fifth reservoir 105 and the sixth reservoir 106.

A first air hole 108*a* and a second air hole 110*a* communicating with the outside of the analysis chip 100 are connected to the eighth reservoir 108 and the tenth reservoir 110, respectively. The air holes 108*a* and 110*a* serve to secure smooth movement of the liquids within the fluid circuit 10 by a centrifugal force. The air holes 108*a* and 110*a* may include, for example, grooves formed on the first substrate and through-holes formed in the second substrate or the sticky seal (sticky label) placed on the first substrate. The through-holes communicate with the grooves. In order to prevent the liquids introduced into the fluid circuit 10 from being leaked through the air holes 108*a* and 110*a*, the air holes 108*a* and 110*a* are arranged nearer to the center portion of the analysis chip 100 than the reservoirs 108 and 110 communicating with the air holes 108*a* and 110*a* are (the air holes 108*a* and 110*a* are arranged at the upstream side of the reservoirs 108 and 110 in the centrifugal direction, respectively). Alternatively, the air holes 108*a* and 110*a* may be arranged in arbitrary positions. For example, the air holes 108*a* and 110*a* may be arranged in the reservoirs other than the eighth reservoir 108 and the tenth reservoir 110, and may also be arranged not only in the eighth reservoir 108 and/or the tenth reservoir 110 but also in other reservoirs.

In order to move the liquids within the fluid circuit 10 to desired reservoirs while preventing the liquids from flowing into the reservoirs connected to the centrifugal downstream side of the desired reservoirs, the cross-sectional areas of the respective flow paths of the fluid circuit 10 may be set to satisfy the following conditions:

Condition [1]: the cross-sectional areas of the first flow path 201, the second flow path 202, the fifth flow path 205, the sixth flow path 206, the seventh flow path 207 and the ninth flow path 209 are larger than the cross-sectional area of the eighth flow path 208; and Condition [2]: the cross-sectional area of the eighth flow path 208 is larger than the cross-sectional areas of the third flow path 203, the fourth flow path 204, the tenth flow path 210, the eleventh flow path 211 and the twelfth flow path 212.

More specifically, in the fluid circuit 10, the width and the depth of the first flow path 201, the second flow path 202, the fifth flow path 205, the sixth flow path 206, the seventh flow path 207 and the ninth flow path 209 may be set to be 600 μm and 800 μm, respectively. The width and the depth of the eighth flow path 208 may be set to be 100 μm and 50 μm, respectively. The width and the depth of the third flow path 203, the fourth flow path 204, the tenth flow path 210, the eleventh flow path 211 and the twelfth flow path 212 may be set to be 100 μm and 30 μm, respectively.

However, the width and the depth of the respective flow paths are not particularly limited as long as the conditions [1] and [2] are satisfied. For example, the respective flow paths may have a width and a depth ranging from several ten μm to several hundred μm (or about one thousand μm). In some embodiments, in the case of performing an examination such as the ELISA or the like through the use of antibody-modified beads, at least one of the cross sections of the eighth flow path 208 needs to be smaller in size than the antibody-modified beads in order to prevent the antibody-modified beads from flowing into the eighth reservoir 108.

In the fluid circuit 10, the volume of the seventh reservoir 107 may be set smaller than the total volume of the second reservoir 102, the third reservoir 103, the ninth reservoir 109 and the tenth reservoir 110. Alternatively, the volume of the seventh reservoir 107 may be equal to the total volume of the second reservoir 102, the third reservoir 103, the ninth reservoir 109 and the tenth reservoir 110.

The seventh reservoir 107 includes a swelling-shaped washing target holding portion 107*a* formed in the bottom portion thereof (at the side of the outer peripheral portion of the analysis chip 100 or at the centrifugal downstream side). If a centrifugal force is applied in the direction indicated by the centrifugal force arrow in FIG. 3, the washing targets, e.g., the beads used in the ELISA (the conjugants of the objective substances, the antibody-modified beads and the enzyme-labeled antibodies), can be trapped within the washing target holding portion 107*a*. The washing effect can be enhanced by providing a route through which the first liquid is directly introduced into the washing target holding portion 107*a*. In the disc-shaped analysis chip 100 of FIG. 2, the route refers to a route passing through the eleventh flow path 211, the tenth reservoir 110 and the twelfth flow path 212 in the named order (see FIG. 3).

For example, if an examination relying upon the ELISA is conducted using the disc-shaped analysis chip 100 of FIG. 2, the first liquid may be a washing fluid, the second liquid may be a liquid containing a specimen containing objective substances as analyzed objects and enzyme-labeled antibodies, the third liquid may be a liquid containing antibody-modified beads, and the fourth liquid may be a substrate solution. The diameters of the antibody-modified beads are not particularly limited but may be, e.g., 75 μm.

With the disc-shaped analysis chip 100 of FIG. 2 having the fluid circuit 10 of the structure described above, when an examination relying upon, e.g., ELISA, is conducted, the fourth reservoir 104 and the fifth reservoir 105 can be washed during the washing process in which the first liquid (washing fluid) in the first reservoir 101 is introduced into the seventh reservoir 107. More specifically, in the washing process, a part of the first liquid in the first reservoir 101 is introduced into the seventh reservoir 107 after passing through the first flow path 201, the second reservoir 102, the third flow path 203, the fourth reservoir 104 and the fifth flow path 205 in the named order, while a part of the first liquid in the first reservoir 101 is also introduced into the seventh reservoir 107 after passing through the second flow path 202, the third reservoir 103, the fourth flow path 204, the fifth reservoir 105 and the sixth flow path 206 in the named order. Therefore, a small amount of the second liquid and the third liquid respectively remaining within the fourth reservoir 104 and the fifth reservoir 105 after the second liquid and the third liquid are introduced into the seventh reservoir 107 is effectively washed and removed by the first liquid. Accordingly, a problem that the second liquid and the third liquid remaining within the fourth reservoir 104 and the fifth reservoir 105, respectively, flow out of the fourth reservoir 104 and the fifth reservoir 105 in a process after the washing process can be prevented, which increases the examination accuracy.

The structure of the fluid circuit 10 is advantageous improving with respect to the washing effect on the beads (the conjugates of the objective substances, the antibody-modified beads and the enzyme-labeled antibodies) in the seventh reservoir 107 during the washing process performed after the process of introducing the second and the third liquid into the seventh reservoir 107. In other words, as will be described later, the washing process may be multi-stage washing in which the process of introducing a part of the first liquid within the first reservoir 101 into the seventh reservoir 107 and washing the beads within the seventh reservoir 107 by repeating the application and release of the centrifugal force is performed by a multiple number of times. During at least the initial stage of the multi-stage washing, the first liquid within the first reservoir 101 is introduced into the seventh reservoir 107 via: (1) a route passing through the ninth flow path 209, the ninth reservoir 109, the tenth flow path 210, the sixth reservoir 106 and the seventh flow path 207 in the named order; (2) a route passing through the second flow path 202, the third reservoir 103, the fourth flow path 204, the fifth reservoir 105 and the sixth flow path 206 in the named order; (3) a route passing through the first flow path 201, the second reservoir 102, the third flow path 203, the fourth reservoir 104 and the fifth flow path 205 in the named order; and (4) a route passing through the eleventh flow path 211, the tenth reservoir 110 and the twelfth flow path 212 in the named order. Since the beads within the seventh reservoir 107 can be washed in multiple directions, the washing effect can be improved. The improved washing effect assists in increasing the examination accuracy.

In order to wash the beads within the seventh reservoir 107 in multiple directions to improve the washing effect, as shown in FIG. 3, the fifth flow path 205, the sixth flow path 206 and the seventh flow path 207 are connected to the first-reservoir-side region of the seventh reservoir 107 while the twelfth flow path 212 is connected to the eighth-reservoir-side region of the seventh reservoir 107. This configuration allows the beads within the seventh reservoir 107 to be brought into contact with the washing fluid introduced into the seventh reservoir 107 from both the upper side (the side of the first reservoir 101) and the lower side (the side of the eighth reservoir 108) of the seventh reservoir 107, thereby washing the beads in a more effective manner. As described above, the twelfth flow path 212 is directly connected to the washing target holding portion 107*a*. This configuration helps improve the washing effect.

The connection point between the eleventh flow path 211 and the first reservoir 101 is positioned nearer to the outer peripheral portion of the analysis chip 100 than the connection points between the ninth flow path 209 and the first reservoir 101, between the second flow path 202 and the first reservoir 101 and between the first flow path 201 and the first reservoir 101. Therefore, the washing of the beads by the first liquid introduced from the route (4) through which the first liquid is directly introduced into the washing target holding portion 107*a* is performed during the multi-stage washing set forth above. This is also advantageous in improving the washing effect.

In the some embodiments, the volume of the seventh reservoir 107 is set to be equal to or smaller than the total volume of the second reservoir 102, the third reservoir 103, the ninth reservoir 109 and the tenth reservoir 110. This configuration also improves the washing effect on the beads in the seventh reservoir 107. More specifically, during at least the initial stage of the multi-stage washing (the washing process), the first liquid is temporarily almost-fully filled in all the buffer reservoirs including the second reservoir 102, the third reservoir 103, the ninth reservoir 109 and the tenth reservoir 110 and then is introduced into the seventh reservoir 107. At this time, with the above-described volume relationship, the seventh reservoir 107 is fully filled with the first liquid. Therefore, the inside of the seventh reservoir 107 can be effectively washed.

If necessary, the structure of the fluid circuit 10 may be modified in many different forms. For example, the fluid circuit 10 may not include the ninth flow path 209, the ninth reservoir 109 and the tenth flow path 210, which make up the route (1), and may not include the eleventh flow path 211, the tenth reservoir 110 and the twelfth flow path 212, which make up the route (4). From the viewpoint of the effect on washing, the fluid circuit 10 may include the reservoirs 109 and 110 as shown in FIG. 3.

Instead of being connected to the sixth reservoir 106, the tenth flow path 210 may be directly connected to the seventh reservoir 107 as shown in the fluid circuit of FIG. 1. In some embodiments, the tenth flow path 210 can be connected to the sixth reservoir 106 as shown in FIG. 3. This allows for the second and the third liquid infiltrated into the seventh flow path 207 during the process of introducing the second and the third liquid into the seventh reservoir 107 can be washed and removed during the washing process, thereby increasing the examination accuracy.

As described above, the present disc-shaped analysis chip 100 can be manufactured by placing and bonding the second substrate on the grooved surface of the first substrate on which the groove pattern corresponding to the fluid circuit (internal space) structure is formed. At least one (or all) of the first inlet port 104*a*, the second inlet port 105*a*, the third inlet port 106*a* and the fourth inlet port 101*a* may be through-holes extending in the thickness direction of the second substrate.

Figure 10:
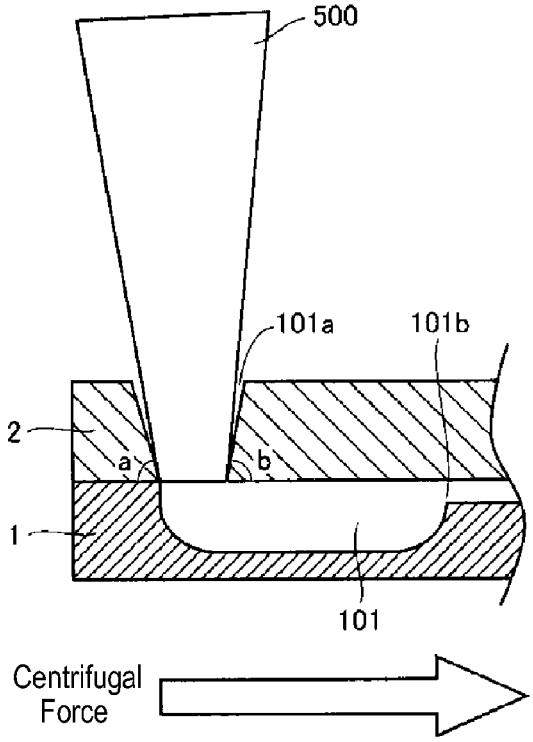
FIG. 10 is a schematic section view illustrating an example of a disc-shaped analysis chip in which a region where a first reservoir is formed is shown in an enlarged scale, according to some embodiments.
Figure 11:
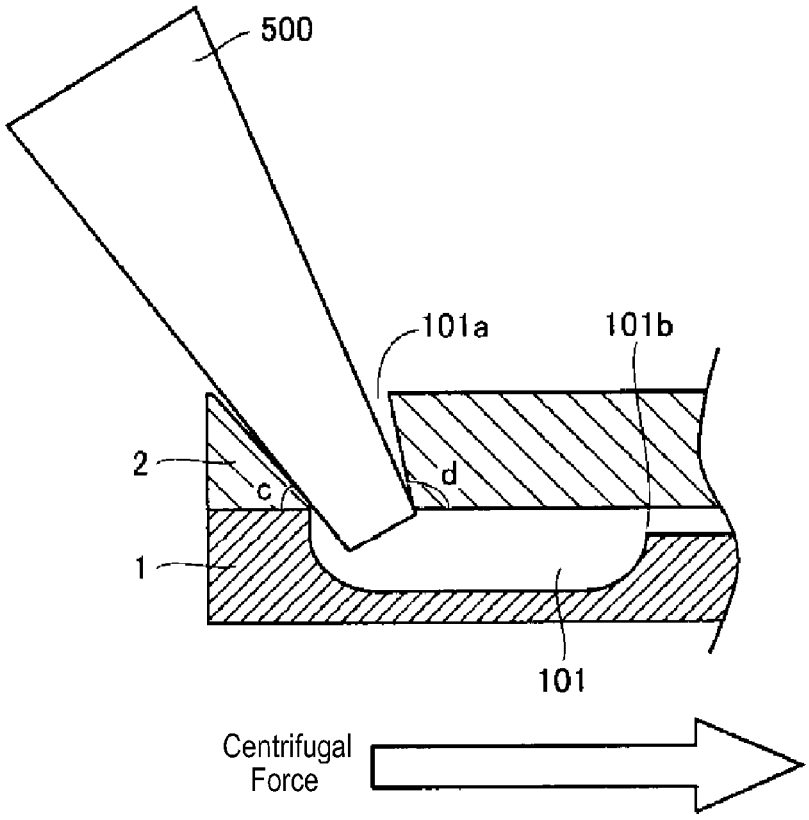
FIG. 11 is another schematic section view illustrating an example of a disc-shaped analysis chip in which a region where a first reservoir is formed is shown in an enlarged scale, according to some other embodiments.

FIGS. 10 and 11 are schematic enlarged section views illustrating the portion of the analysis chip 100 in which the first reservoir 101 is formed. In FIGS. 10 and 11, the disc-shaped analysis chip 100 is a laminated body of the first substrate 1 and the second substrate 2. The fluid circuit (internal space) including the first reservoir 101 is defined by the grooves formed on one surface of the first substrate 1 and a surface of the second substrate 2 facing the first substrate 1. The fourth inlet port 101*a* is a through-hole extending in the thickness direction of the second substrate 2.

As shown in FIGS. 10 and 11, the through-hole forming the fourth inlet port 101*a* (or the through-holes forming other inlet ports) may be formed into a taper shape such that the diameter of the through-hole grows smaller toward the first substrate 1. The liquids may be injected into the respective reservoirs through the use of a pipette. By forming the through-hole (the inlet port 101*a*) into a taper shape, it becomes easy to find the position of the inlet port 101*a*. The through-hole (the inlet port 101*a*) serves to guide the tip end of a pipette tip 500, whereby the tip end of the pipette tip 500 can be guided into the through-hole (the inlet port 101*a*) with ease.

As shown in FIG. 10, the through-hole (the inlet port 101*a*) may extend in the direction perpendicular to the surface of the second substrate 2. This configuration allows the pipette tip 500 to be easily inserted in the direction perpendicular to the surface of the second substrate 2. In the example shown in FIG. 10, the taper angles a and b are equal to each other. The taper angles a and b may be, e.g., 10 to 80 degrees, and in some embodiments, may be 20 to 70 degrees.

As illustrated in FIG. 11, the through-hole (the inlet port 101*a*) may obliquely extend with respect to the surface of the second substrate 2 such that the through-hole (the inlet port 101*a*) comes closer to the outer peripheral portion of the analysis chip 100 (to the outlet port 101*b* of the first reservoir 101 in FIG. 11) as it extends toward the first substrate 1 (such that the through-hole (the inlet port 101*a*) comes to the downstream side in the centrifugal direction as it extends toward the first substrate 1). Accordingly, even if the liquid is left within the through-hole (the inlet port 101*a*) during the liquid injection time, the liquid remaining within the through-hole (the inlet port 101*a*) is drawn into the first reservoir 101 at the time when the centrifugal force is applied. Therefore, the liquid can be prevented from being leaked out toward the outer surface of the first substrate 1.

In the example illustrated in FIG. 11, the taper angle c may be, e.g., 10 to 80 degrees, and in some embodiments, may be 20 to 70 degrees. The taper angle d may be, e.g., 100 to 170 degrees, and in some embodiments, 110 to 160 degrees.

<Method of Using the Disc-Shaped Analysis Chip>

Referring now to FIGS. 4 to 8, description will be made on some embodiments in which an examination relying on the ELISA is conducted by using the present disc-shaped analysis chip 100 of FIG. 2. FIGS. 4 to 8 are schematic top views illustrating liquid states in the respective processes during the ELISA using the present disc-shaped analysis chip 100 having the fluid circuit 10 shown in FIG. 3.

Figure 4:
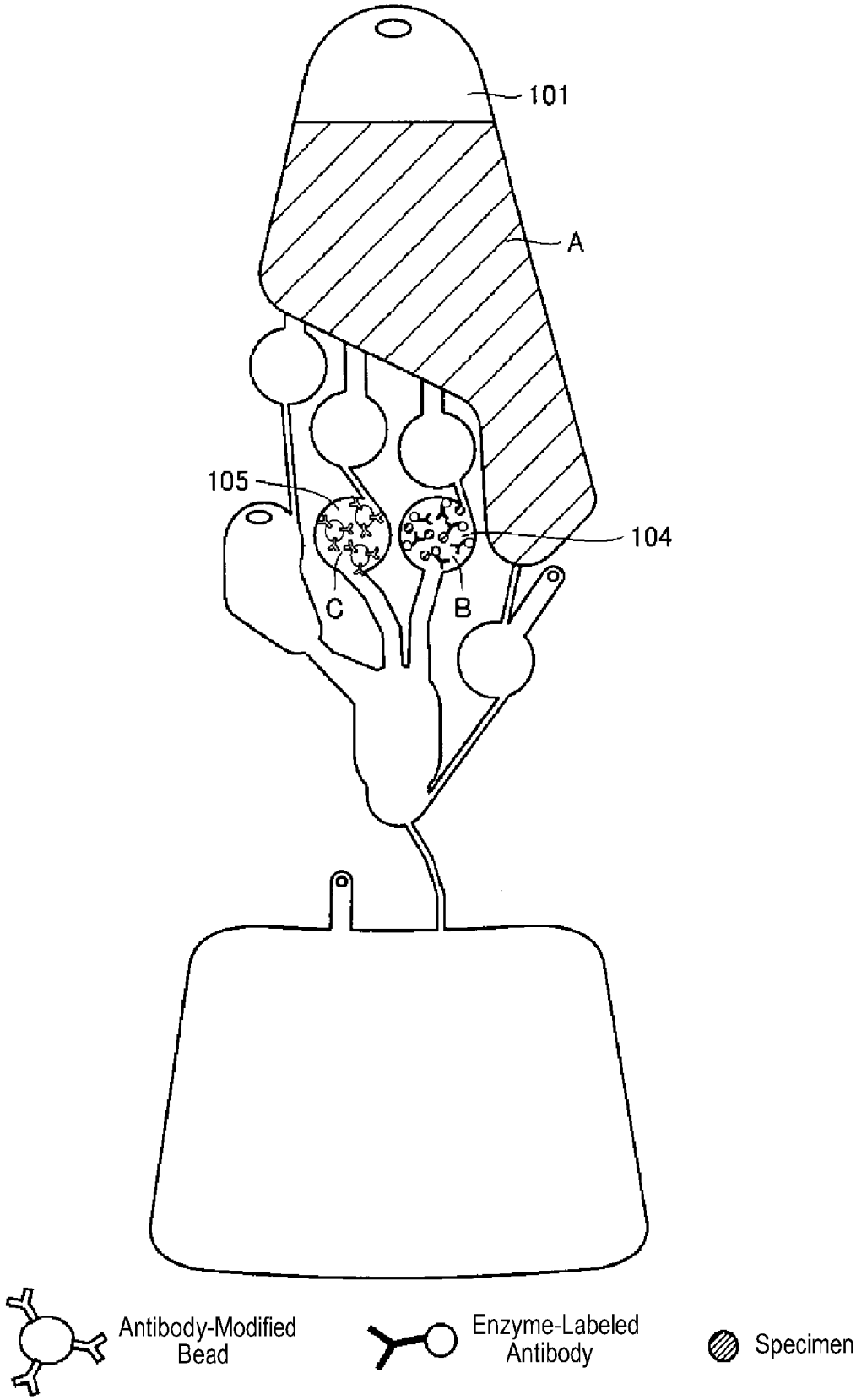
FIG. 4 is a schematic top view illustrating a liquid state in a first liquid introduction process during an ELISA using the disc-shaped analysis chip having the fluid circuit shown in FIG. 3.

FIG. 4 illustrates the liquid states when a first liquid is introduced to a fluid structure of the analysis chip 100 (first liquid receiving introduction process, FIG. 4). First, a washing fluid A as the first liquid is introduced into the first reservoir 101. A liquid B as the second liquid containing a specimen to be analyzed and enzyme-labeled antibodies is introduced into the fourth reservoir 104. A liquid C as the third liquid containing antibody-modified beads is introduced into the fifth reservoir 105. The introduction of the washing fluid A and the liquids B and C can be performed by injecting the liquids A to C via inlet ports (i.e., the fourth inlet port 101*a*, the first inlet port 104*a* and the second inlet port 105*a*) of the respective reservoirs 101, 104 and 105 through the use of a pipette or the like.

Figure 5:
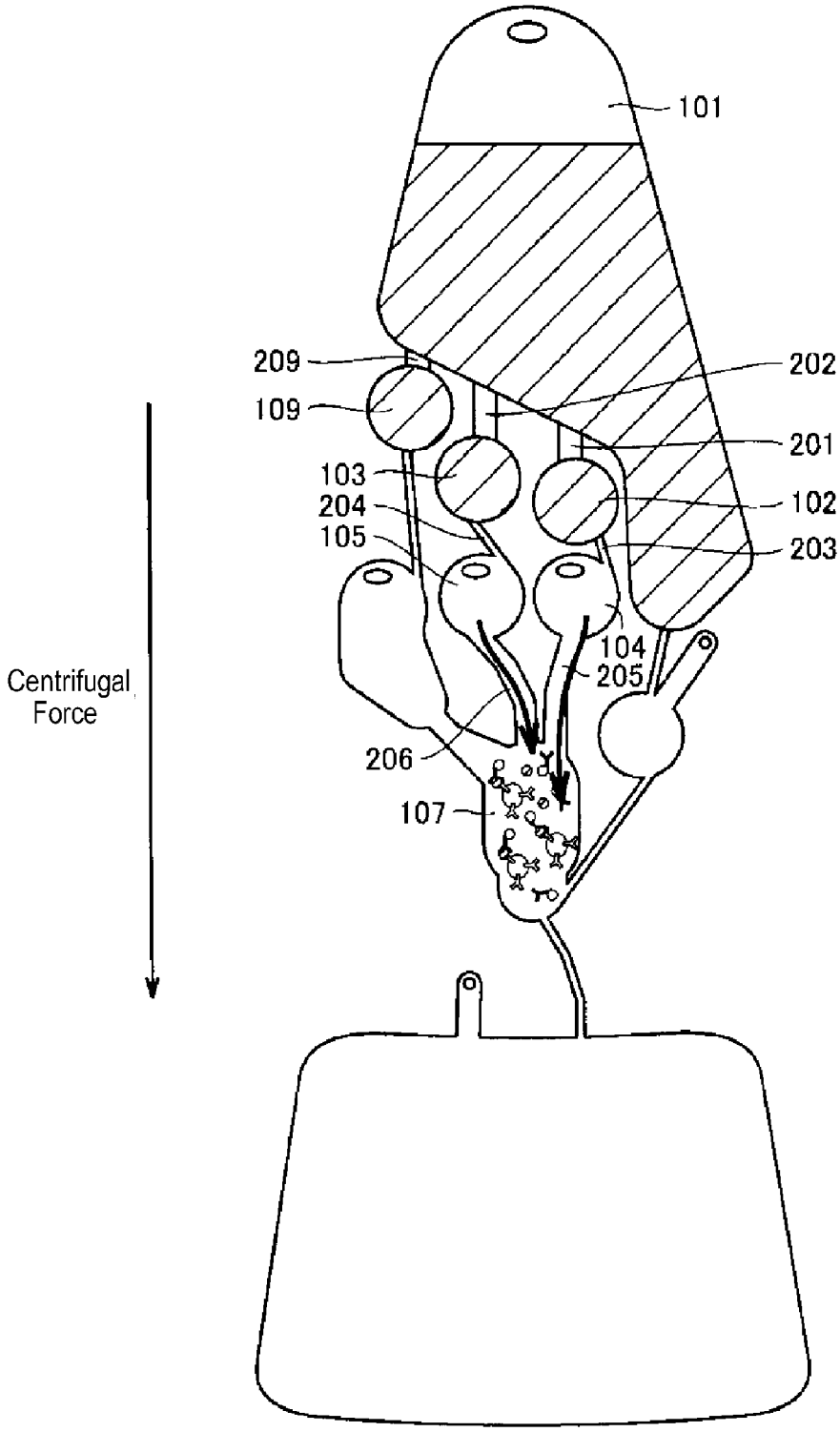
FIG. 5 is a schematic top view illustrating a liquid state in a first reaction process during an ELISA using the disc-shaped analysis chip having the fluid circuit shown in FIG. 3.

Referring next to FIG. 5, the analysis chip 100 is rotated about the center thereof so that a first centrifugal force can be applied to the analysis chip 100 in the direction shown in FIG. 5. Consequently, the liquid B is introduced into the seventh reservoir 107 through the fifth flow path 205 and the liquid C is introduced into the seventh reservoir 107 through the sixth flow path 206. The liquid B and the liquid C are mixed with each other and subjected to an antigen-antibody reaction (a first reaction process). The magnitude of the first centrifugal force is set such that the liquid B and the liquid C are prevented from flowing into the eighth reservoir 108 through the eighth flow path 208. By the application of the first centrifugal force, the washing fluid A is introduced into the buffer reservoirs, namely the second reservoir 102, the third reservoir 103 and the ninth reservoir 109. Since the magnitude of the first centrifugal force is set such that the liquid B and the liquid C are prevented from flowing into the eighth reservoir 108 through the eighth flow path 208, the washing fluid A is prevented from flowing into the third flow path 203, the fourth flow path 204 and the tenth flow path 210, which are smaller in cross-sectional area than the eighth flow path 208.

Figure 6:
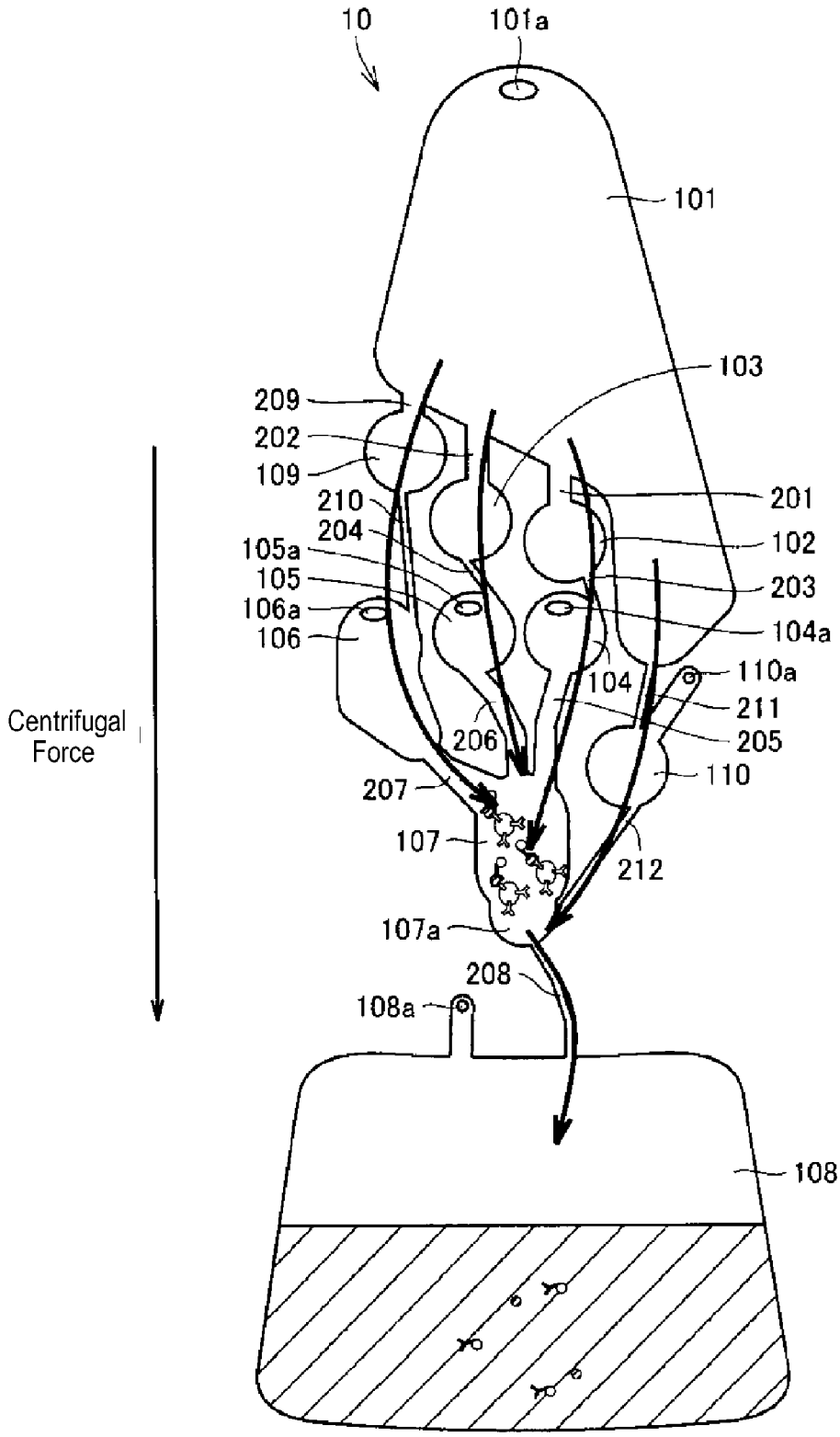
FIG. 6 is a schematic top view illustrating a liquid state in a washing process during an ELISA using the disc-shaped analysis chip having the fluid circuit shown in FIG. 3.

Referring next to FIG. 6, a second centrifugal force is applied to the analysis chip 100 in the direction shown in FIG. 6. Thus, the washing fluid A is introduced into the seventh reservoir 107 to wash the reacted beads and the used washing fluid A is moved to the eighth reservoir 108 through the eighth flow path 208, thereby discarding the washing fluid A (a washing process). The unreacted specimen and the unreacted enzyme-labeled antibodies are removed in the washing process. The magnitude of the second centrifugal force needs to be large enough to move the washing fluid A, and is at least larger than the magnitude of the first centrifugal force. The washing fluid A is introduced into the seventh reservoir 107 through the flow path smaller in cross-sectional area than the eighth flow path 208. Therefore, the liquid fraction of the unreacted liquid in the seventh reservoir 107 is discharged to the eighth reservoir 108 after the first reaction process. Then, the washing fluid A is introduced into the seventh reservoir 107.

The present washing process may include a multiple number of steps of introducing a part of the washing fluid A within the first reservoir 101 into the seventh reservoir 107, washing the beads within the seventh reservoir 107 and discharging the used washing fluid A to the eighth reservoir 108. In other words, the washing fluid A can be divisionally (in a multi-step manner) introduced into the seventh reservoir 107 by arranging the buffer reservoirs (the second reservoir 102, the third reservoir 103, the ninth reservoir 109 and the tenth reservoir 110) on the routes extending from the first reservoir 101 to the seventh reservoir 107. The divisional introduction can be performed for the following reasons. During the application of the second centrifugal force, continuous liquid flows pass the buffer reservoirs. However, upon releasing the second centrifugal force, the liquid flows are divided into sections in the buffer reservoirs. Accordingly, the multi-stage washing of the beads in the seventh reservoir 107 can be implemented by repeating the application and release of the second centrifugal force.

As described above, during at least the initial stage of the multi-stage washing, the washing fluid A in the first reservoir 101 is introduced into the seventh reservoir 107 through the routes (1) to (4) (see FIG. 6). Thus the beads in the seventh reservoir 107 can be washed in multiple directions, and all the reservoirs including the fourth reservoir 104 and the fifth reservoir 105 and the flow paths, which exist on the routes extending from the first reservoir 101 to the seventh reservoir 107, can be washed. Since the seventh reservoir 107 is fully filled with the washing fluid A during at least the initial stage of the multi-stage washing, the inside of the seventh reservoir 107 can be effectively washed.

As the multi-stage washing proceeds, the liquid level of the washing fluid A in the first reservoir 101 grows lower. Therefore, the supply routes of the washing fluid A, i.e., the four routes (1) to (4), are reduced step by step and finally, the washing fluid A is introduced into the seventh reservoir 107 via only the route (4). The washing process is usually performed until the washing fluid A in the first reservoir 101 is completely consumed and discharged to the eighth reservoir 108.

Figure 7:
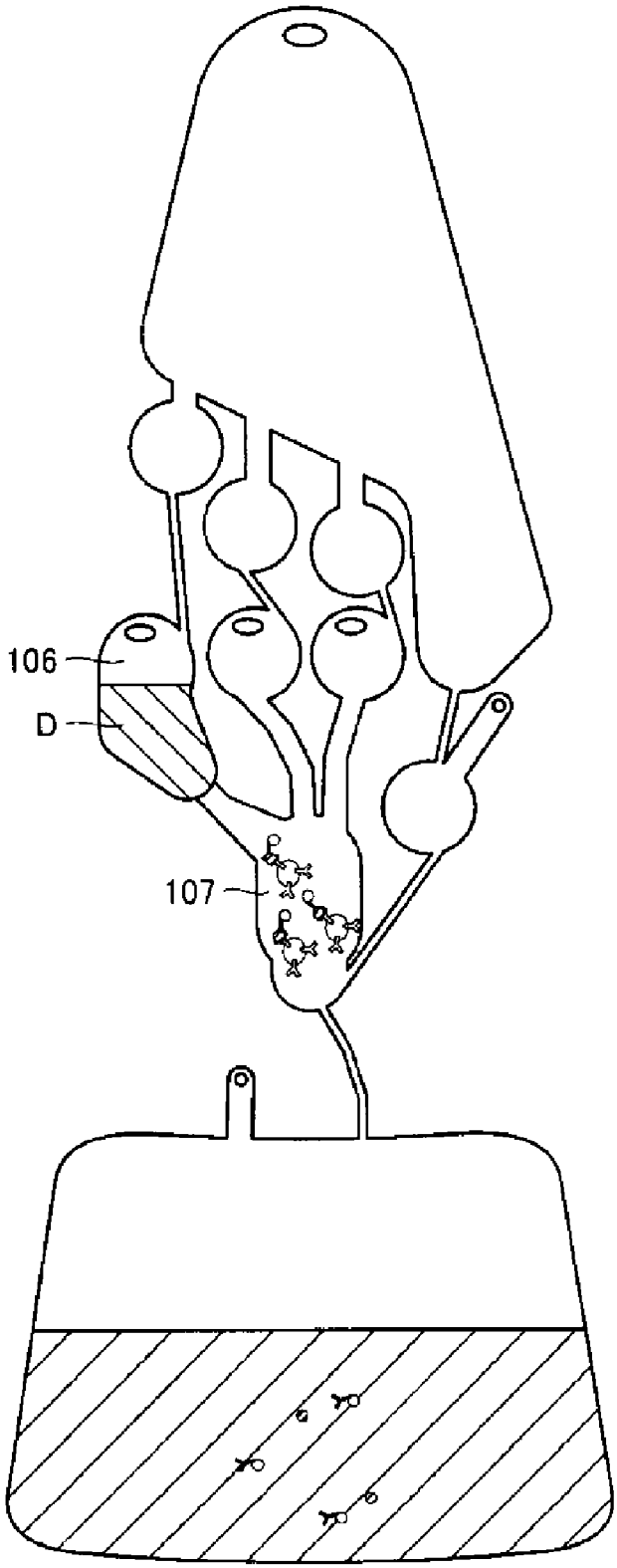
FIG. 7 is a schematic top view illustrating a liquid state in a second liquid introduction process during an ELISA using the disc-shaped analysis chip having the fluid circuit shown in FIG. 3.
Figure 8:
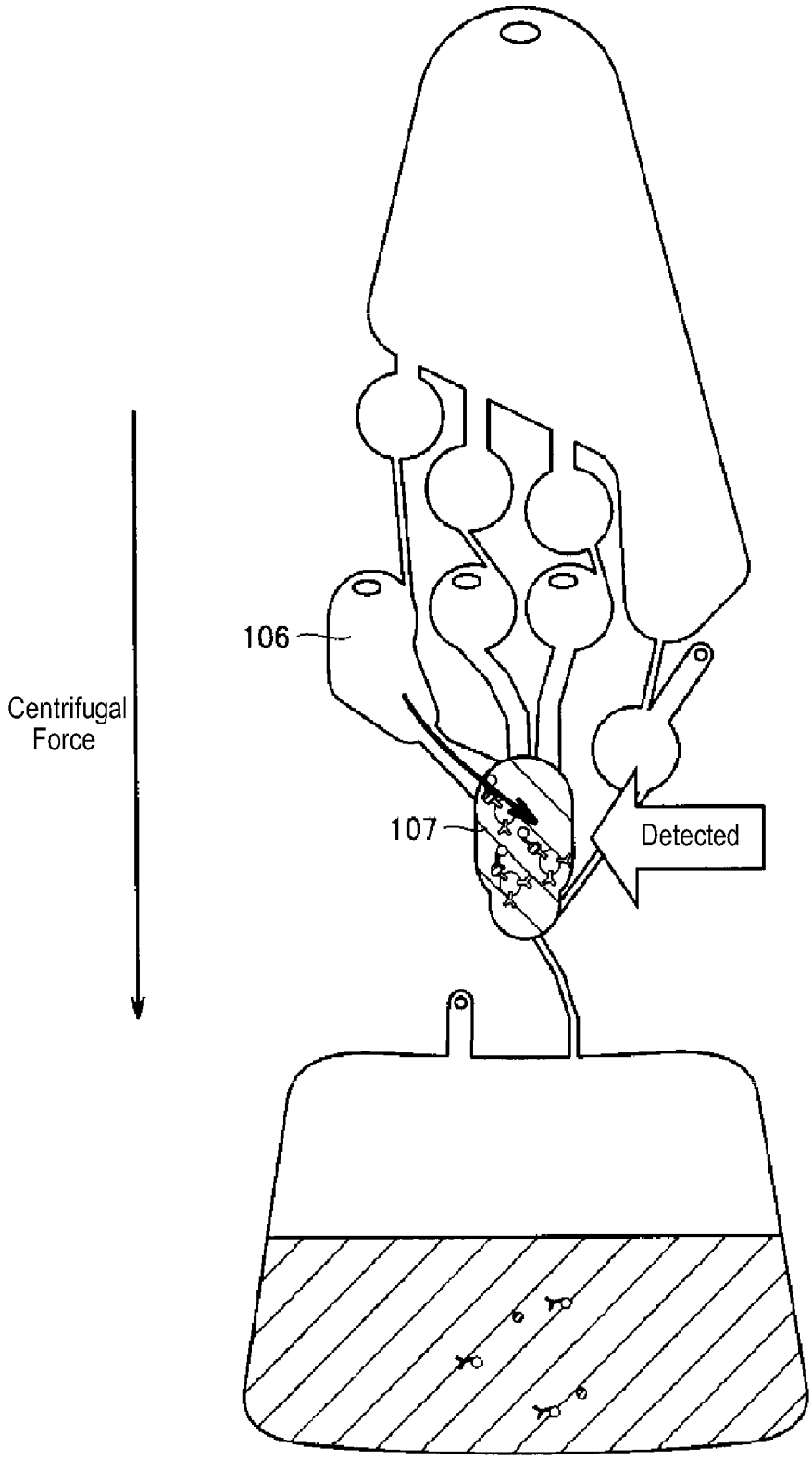
FIG. 8 is a schematic top view illustrating a liquid state in a second reaction process during an ELISA using the disc-shaped analysis chip having the fluid circuit shown in FIG. 3.

Next, a substrate solution D as the fourth liquid is introduced into the sixth reservoir 106 (a second liquid introduction process, FIG. 7). A third centrifugal force is applied to the analysis chip 100 in the direction shown in FIG. 8, whereby the substrate solution D is introduced into the seventh reservoir 107 through the seventh flow path 207 and subjected to an enzyme reaction with the washed beads (a second reaction process, FIG. 8). The magnitude of the third centrifugal force is substantially equal to that of the first centrifugal force and set such that the liquid in the seventh reservoir 107 is prevented from flowing into the eighth reservoir 108 through the eighth flow path 208.

Finally, the fluorescent material produced within the seventh reservoir 107 as a result of the enzyme reaction is detected by performing optical measurement, e.g., by irradiating detection light on the seventh reservoir 107. Thus the objective substances are quantified (a detection process).

Figure 9:
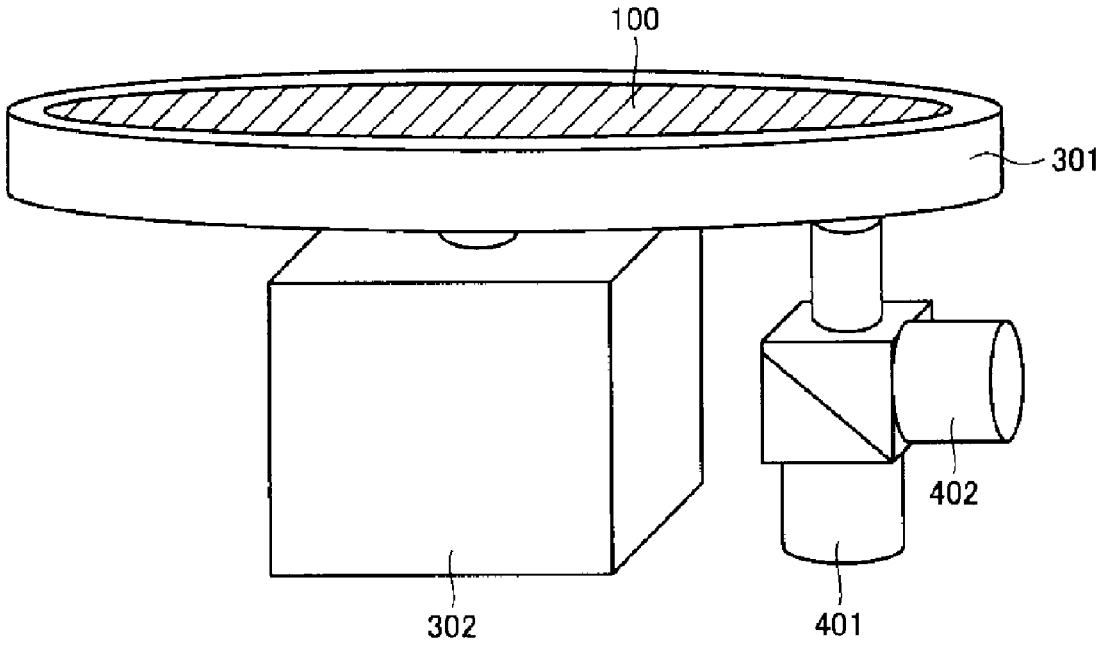
FIG. 9 is a schematic view illustrating a rotation device configured to rotate the disc-shaped analysis chip of FIG. 2 and an optical measurement device configured to perform optical measurements, according to some embodiments.

The rotation of the analysis chip 100 and the optical measurement in the detection process can be performed by using a rotation device and an optical measurement device shown in FIG. 9. The rotation device shown in FIG. 9 includes a turntable 301 and a motor 302 configured to rotate the turntable 301. The disc-shaped analysis chip 100 is mounted on the turntable 301. The turntable 301 is rotated by the motor 302, whereby a centrifugal force directing toward the outer peripheral portion of the analysis chip 100 can be applied to the analysis chip 100. The magnitude of the centrifugal force is controlled by the rotation speed of the turntable 301.

The optical measurement device shown in FIG. 9 includes a light source 401 configured to irradiate detection light on a specific region of the fluid circuit (e.g., the seventh reservoir 107 in the embodiment described above) and a light detector 402 configured to detect fluorescence emitted from a fluorescent material. An LED (Light Emitting Diode) or an LD (Laser Diode) can be used as the light source 401. A PD (Photo Diode), an APD (Avalanche Photo Diode) or a PM (Photomultiplier) can be used as the light detector 402.

EXAMPLES

While the present disclosure will now be described in detail with reference to certain examples, the present disclosure is not limited thereto.

Example 1

The disc-shaped analysis chip having a diameter of 12 cm and a thickness of 2 mm was manufactured. The disc-shaped analysis chip has the same configuration as shown in FIG. 2 except that the total number of the fluid circuits is sixteen. The disc-shaped analysis chip includes a first substrate made of a PMMA resin and provided with groove patterns forming the fluid circuits and a sticky label laminated on the first substrate. Each of the fluid circuits has a structure shown in FIG. 3. Below, description will be made by using the same reference numerals to those in FIG. 3. The width and depth of the first flow path 201, the second flow path 202, the fifth flow path 205, the sixth flow path 206, the seventh flow path 207 and the ninth flow path 209 are 600 μm and 800 μm, respectively. The width and depth of the eighth flow path 208 are 100 μm and 50 μm, respectively. The width and depth of the third flow path 203, the fourth flow path 204, the tenth flow path 210, the eleventh flow path 211 and the twelfth flow path 212 are 100 μm and 30 μm, respectively.

A blocking agent composed of a BSA (Bovine Serum Albumin) solution containing 2 wt % of BSA and 0.05 wt % of surfactant was injected to fill all the fluid circuits 10, and blocking was performed at 37 degrees C. for 30 minutes.

Reference Example 1

A disc-shaped analysis chip having the same configuration as the analysis chip of Example 1, except that the fluid circuits thereof have a structure shown in FIG. 1, was manufactured. The fluid circuits were subjected to blocking in the same manner as in Example 1.

<Evaluation of Washing Effect>

(1) An enzyme-labeled antibody solution having a concentration of 200 ng/mL (and containing 0.2 wt % of BSA and 0.05 wt % of surfactant) was injected into the fourth reservoir 104 of the analysis chip of Example 1. Then, the enzyme-labeled antibody solution was introduced into the seventh reservoir 107 by rotating the analysis chip to apply a first centrifugal force to the analysis chip. The enzyme-labeled antibody solution was left alone for 30 minutes at the room temperature, thereby causing non-specific adsorption. Thereafter, the enzyme-labeled antibody solution was discharged to the eighth reservoir 108 by applying a second centrifugal force to the analysis chip. Subsequently, 10 μL of PBS (Phosphate-Buffered Saline) was injected into the first reservoir 101. The inside of the seventh reservoir 107 was subjected to multi-stage washing by repeating the application and release of the second centrifugal force. Then, a substrate solution was injected into the sixth reservoir 106 and introduced into the seventh reservoir 107 by the application of a third centrifugal force, and an enzyme reaction was performed for 10 minutes. In such a state, the intensity of the fluorescence thus generated by the enzyme reaction was measured.

The washing tests described above was conducted five times in total. Test numbers 1 to 5 are assigned to the respective five washing tests, and the results are shown in Table 1. The term "average fluorescence intensity" in the respective washing tests means an average value of fluorescence intensities (a.u.) of eight fluid circuits arbitrarily selected from the sixteen fluid circuits of the analysis chip (This holds true in the washing tests to be described later). Each of the numerical values included in parentheses in Table 1 denotes a CV (Coefficient of Variation) (%). The term "total of washing tests 1-5" in Table 1 means the average value of fluorescence intensities and average value of the CVs with respect to forty tests (eight fluid circuits×five tests) (This holds true in Table 2).

(2) The same washing tests as in the item (1) described above were conducted with respect to the analysis chip of Reference Example 1. More specifically, the same enzyme-labeled antibody solution as described above was injected into the reservoir 20 of the analysis chip of Reference Example 1. Then, the enzyme-labeled antibody solution was introduced into the reservoir 60 by applying a fourth centrifugal force to the analysis chip. The enzyme-labeled antibody solution was left alone for 30 minutes at the room temperature, thereby causing non-specific adsorption. Thereafter, the enzyme-labeled antibody solution was discharged to the reservoir 70 by applying a fifth centrifugal force thereto. Subsequently, 80 μL of PBS was injected into the reservoir 40. The inside of the reservoir 60 was subjected to multi-stage washing by repeating the application and release of the fifth centrifugal force. Then, a substrate solution was injected into the reservoir 50 and introduced into the reservoir 60 by the application of a sixth centrifugal force, and an enzyme reaction was performed for 10 minutes. In such a state, the intensity of the fluorescence thus generated by the enzyme reaction was measured. The washing test described above was conducted twice in total. Test numbers 6 and 7 are assigned to these two washing tests, and the results are shown in Table 1.

(3) The following washing test was conducted with respect to the analysis chip of Reference Example 1. The steps leading to the step of discharging the enzyme-labeled antibody solution to the reservoir 70 are the same as those of item (2) described above. Next, a set of washing operations was performed three times in total. The set of washing operations includes: 1) the multi-stage washing of the inside of the reservoir 60 performed by injecting 80 μL of PBS into the reservoir 40 and repeating the application and release of the fifth centrifugal force; 2) the washing of the inside of the reservoir 60 performed by injecting 5 μL of PBS into the reservoir 20 and introducing the PBS into the reservoir 60 through the application of the fifth centrifugal force; and 3) the washing of the inside of the reservoir 60 performed by injecting 10 μL of PBS into the reservoir 50 and introducing the PBS into the reservoir 60 through the application of the fifth centrifugal force. Thereafter, the fluorescence intensity was measured in the same manner as in item (2) described above. This washing test was conducted only once. A test number 8 is assigned to the washing test, and the results are shown in Table 1.

As shown in Table 1, the analysis chip of Example 1 exhibits desirable washing effects to the analysis chip of Reference Example 1. The fluorescence intensity (background) available when only the substrate solution is introduced into the seventh reservoir 107 without introducing the enzyme-labeled antibody solution and the PBS into the seventh reservoir 107 is approximately from 22 to 23. With the analysis chip of Example 1, in the washing test of item (1) described above, the inside of the seventh reservoir 107 can be washed to such a level that the fluorescence intensity obtained by the multi-stage washing becomes equal to the background.

In contrast, the analysis chip of Reference Example 1 exhibits relatively high fluorescence intensity than the analysis chip of Example 1 does, even though the multi-stage washing was performed (in the washing test (2)). Presumably, this is because the reservoir 20 cannot be washed and because a small amount of the enzyme-labeled antibody solution remaining within the reservoir 20 flows into the reservoir 60 in the process subsequent to the washing process. Even in the washing operation (the washing test (3)) of directly injecting the PBS into the reservoirs 20 and 50 and then washing the reservoirs 20 and 50, the washing effect as is available in the analysis chip of Example 1 was not obtained.

TABLE 1

| Washing Test No. | Analysis Chip | Average Fluorescence Intensity | CV |
|---|---|---|---|
| 1 | Example 1 | 17.2 | 24.3 |
| 2 | Example 1 | 14.7 | 11.5 |
| 3 | Example 1 | 25.0 | 33.8 |
| 4 | Example 1 | 16.9 | 7.6 |
| 5 | Example 1 | 18.6 | 58.3 |
| Total of Washing Tests 1-5 | | 19.1 | 45.0 |
| 6 | Reference Example 1 | 32.0 | 21.8 |
| 7 | Reference Example 1 | 71.1 | 68.5 |
| 8 | Reference Example 1 | 49.6 | 23.2 |

(4) The washing effect available when the beads are introduced into the fluid circuit in the same manner as in the ELISA was evaluated with respect to the analysis chip of Example 1. First, 0.25 μg of blocked beads (each having a diameter of 80 μm) and an enzyme-labeled antibody solution having a concentration of 200 ng/mL (and containing 0.2 wt % of BSA and 0.05 wt % of surfactant) were injected into the fourth reservoir 104 of the analysis chip of Example 1. Then, the blocked beads and the enzyme-labeled antibody solution were introduced into the seventh reservoir 107 by rotating the analysis chip and applying the first centrifugal force to the analysis chip. The blocked beads and the enzyme-labeled antibody solution were left alone for 30 minutes at the room temperature, thereby causing non-specific adsorption. Thereafter, the liquid existing within the seventh reservoir 107 was discharged to the eighth reservoir 108 by applying the second centrifugal force thereto. Subsequently, 100 μL of PBS (Phosphate-Buffered Saline) was injected into the first reservoir 101. The beads were subjected to multi-stage washing by repeating the application and removal of the second centrifugal force. Then, a substrate solution was injected into the sixth reservoir 106 and introduced into the seventh reservoir 107 by the application of the third centrifugal force, and an enzyme reaction was performed for 10 minutes. In such a state, the intensity of the fluorescence thus generated by the enzyme reaction was measured. The washing test described above was conducted seven times in total. Test numbers 9 to 15 are assigned to these seven washing tests and the results are shown in Table 2.

TABLE 2

| Washing Test No. | Analysis Chip | Average Fluorescence Intensity | CV |
|---|---|---|---|
| 9 | Example 1 | 41.9 | 34.5 |
| 10 | Example 1 | 49.9 | 29.7 |
| 11 | Example 1 | 53.8 | 17.2 |
| 12 | Example 1 | 39.8 | 10.0 |
| 13 | Example 1 | 66.4 | 45.7 |
| 14 | Example 1 | 35.9 | 27.1 |
| 15 | Example 1 | 43.1 | 29.8 |
| Total of Washing Tests 9-15 | | 47.3 | 45.0 |

While certain embodiments have been described, these embodiments have been presented by way of example only, and are not intended to limit the scope of the disclosures. Indeed, the novel analysis chip described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A disc-shaped analysis chip having an internal space and configured to move liquids in the internal space to desired positions within the internal space by application of a centrifugal force, wherein the internal space comprises:

a first reservoir configured to accommodate therein a first liquid;

a second reservoir and a third reservoir arranged nearer to an outer peripheral portion of the analysis chip than the first reservoir, the second reservoir having a first side and a second side, the second side of the second reservoir being located nearer to the outer peripheral portion than the first side of the second reservoir, and the third reservoir having a first side and a second side, the second side of the third reservoir being located nearer to the outer peripheral portion than the first side of the third reservoir;

a fourth reservoir configured to accommodate therein a second liquid;

a fifth reservoir configured to accommodate therein a third liquid; and a sixth reservoir configured to accommodate therein a fourth liquid, the fourth to the sixth reservoirs being arranged nearer to the outer peripheral portion of the analysis chip than the second and the third reservoirs, the fourth reservoir having a first side and a second side, the second side of the fourth reservoir being located nearer to the outer peripheral portion than the first side of the fourth reservoir, the fifth reservoir having a first side and a second side, the second side of the fifth reservoir being located nearer to the outer peripheral than the first side of the fifth reservoir, and the sixth reservoir having a first side and a second side, the second side of the sixth reservoir being located nearer to the outer peripheral portion than the first side of the sixth reservoir;

a seventh reservoir arranged nearer to the outer peripheral portion of the analysis chip than the fourth to the sixth reservoirs, the seventh reservoir having a first side and a second side, the second side of the seventh reservoir being located nearer to the outer peripheral portion than the first side of the seventh reservoir;

an eighth reservoir arranged nearer to the outer peripheral portion of the analysis chip than the seventh reservoir;

a first flow path configured to interconnect the first reservoir to the second reservoir at the first side of the second reservoir;

a second flow path configured to interconnect the first reservoir to the third reservoir at the first side of the third reservoir;

a third flow path configured to interconnect the second side of the second reservoir to the first side of the fourth reservoir;

a fourth flow path configured to interconnect the second side of the third reservoir to the first side of the fifth reservoir;

a fifth flow path configured to interconnect the second side of the fourth reservoir to the first side of the seventh reservoir;

a sixth flow path configured to interconnect the second side of the fifth reservoir to the first side of the seventh reservoir;

a seventh flow path configured to interconnect the second side of the sixth reservoir to first side of the seventh reservoir; and an eighth flow path configured to interconnect the second side of the seventh reservoir to the eighth reservoir;

wherein the cross-sectional areas of the first, second, fifth, sixth, and seventh flow paths are larger than the cross-sectional area of the eighth flow path, wherein the cross-sectional area of the eighth flow path is larger than the cross-sectional areas of the third and fourth flow paths, and wherein the fourth reservoir has a first inlet port configured to communicate with the outside of the analysis chip to introduce therethrough the second liquid into the fourth reservoir, the fifth reservoir has a second inlet port configured to communicate with the outside of the analysis chip to introduce therethrough the third liquid into the fifth reservoir, the sixth reservoir has a third inlet port configured to communicate with the outside of the analysis chip to introduce therethrough the fourth liquid into the sixth reservoir, and the first reservoir has a fourth inlet port configured to communicate with the outside of the analysis chip to introduce therethrough the first liquid into the first reservoir.

2. The analysis chip of claim 1, wherein the internal space further includes:

a ninth reservoir arranged nearer to the outer peripheral portion of the analysis chip than the first reservoir;

a ninth flow path configured to interconnect the ninth reservoir and the first reservoir;

a tenth flow path configured to interconnect the ninth reservoir and the sixth reservoir;

a tenth reservoir arranged nearer to the outer peripheral portion of the analysis chip than the first reservoir;

an eleventh flow path configured to interconnect the tenth reservoir and the first reservoir; and a twelfth flow path configured to interconnect the tenth reservoir and the seventh reservoir.

3. The analysis chip of claim 2, wherein the cross-sectional area of the ninth flow path is larger than the cross-sectional area of the eighth flow path, and wherein the cross-sectional area of the eighth flow path is larger than the cross-sectional areas of the tenth, eleventh and twelfth flow paths.

4. The analysis chip of claim 2, wherein the volume of the seventh reservoir is equal to or smaller than the total volume of the second, third, ninth and tenth reservoirs.

5. The analysis chip of claim 2, wherein the fourth, fifth and sixth reservoirs have a first inlet port configured to communicate with the outside of the analysis chip to introduce therethrough the second liquid into the fourth reservoir, a second inlet port configured to communicate with the outside of the analysis chip to introduce therethrough the third liquid into the fifth reservoir and a third inlet port configured to communicate with the outside of the analysis chip to introduce therethrough the fourth liquid into the sixth reservoir, respectively, and wherein the first, second and third inlet ports are arranged in a position deviated from a straight line extending in a centrifugal direction from a connection point between the third flow path and the fourth reservoir, in a position deviated from a straight line extending in the centrifugal direction from a connection point between the fourth flow path and the fifth reservoir and in a position deviated from a straight line extending in the centrifugal direction from a connection point between the tenth flow path and the sixth reservoir, respectively.

6. The analysis chip of claim 2, wherein a connection point between the eleventh flow path and the first reservoir is positioned nearer to the outer peripheral portion of the analysis chip than connection points of the ninth flow path, the second flow path and the first flow path to the first reservoir.

7. The analysis chip of claim 2, wherein the fifth, sixth and seventh flow paths are connected to a region of the seventh reservoir facing the first reservoir, and wherein the twelfth flow path is connected to a region of the seventh reservoir facing the eighth reservoir.

8. The analysis chip of claim 1, further comprising a first substrate having grooves formed on one surface thereof and a second substrate laminated on the grooved surface of the first substrate, and wherein the internal space is defined by the grooves and a surface of the second substrate facing the first substrate.

9. The analysis chip of claim 8, wherein at least one of the first to the fourth inlet ports is a through-hole extending through the second substrate in a thickness direction of the second substrate.

10. The analysis chip of claim 9, wherein the through-hole is formed into a taper shape such that the diameter of the through-hole grows smaller toward the first substrate.

11. The analysis chip of claim 10, wherein the through-hole extends in a direction perpendicular to a surface of the second substrate.

12. The analysis chip of claim 10, wherein the through-hole obliquely extends with respect to a surface of the second substrate such that the through-hole comes closer to the outer peripheral portion of the analysis chip as the through-hole extends toward the first substrate.

13. A method of using the disc-shaped analysis chip of claim 3, comprising the sequential steps of:

introducing a washing fluid as the first liquid into the first reservoir of the analysis chip;

introducing a liquid containing a specimen to be analyzed and enzyme-labeled antibodies as the second liquid into the fourth reservoir;

introducing antibody-modified beads as the third liquid into the fifth reservoir;

providing the second liquid and the third liquid into the seventh reservoir through the fifth flow path and the sixth flow path, respectively, by application of a first centrifugal force to create a reaction process in the seventh reservoir involving the second liquid and the third liquid with each other;

providing the washing fluid of the first reservoir into the seventh reservoir by application of a second centrifugal force larger than the first centrifugal force in order to perform a washing process in order to wash the antibody-modified beads remaining in the seventh reservoir after the reaction process and to move the first liquid that is used as a washing fluid to an eighth reservoir through the eighth flow path;

introducing a substrate solution as the fourth liquid into the sixth reservoir;

providing the fourth liquid into the seventh reservoir through the seventh flow path by application of a third centrifugal force to react the fourth liquid with the antibody-modified beads in the seventh reservoir after the washing process, wherein, in the washing process, the first liquid of the first reservoir is introduced into the seventh reservoir via a first route, a second route, a third route and a fourth route:

the first route involving the first liquid passing through the ninth flow path to the ninth reservoir, from the ninth reservoir through the tenth flow path to the sixth reservoir, and from the seventh flow path to the seventh reservoir;

the second route involving the first liquid passing through the second flow path to the third reservoir, from the third reservoir through the fourth flow path to the fifth reservoir, and from the fifth reservoir through the sixth flow path to the seventh reservoir;

the third route involving the first liquid passing through the first flow path to the second reservoir, from the second reservoir through the third flow path to the fourth reservoir, and from the fourth reservoir through the fifth flow path to the seventh reservoir;

and the fourth route involving the first liquid passing through the eleventh flow path to the tenth reservoir, and from the tenth reservoir through the twelfth flow path to the seventh reservoir.

* * * * *